US005329954A

United States Patent [19]

Miyoshi

[11] Patent Number: 5,329,954

[45] Date of Patent: Jul. 19, 1994

[54] STICK-LIKE MEANS FOR PHYSICALLY HANDICAPPED PERSON

[75] Inventor: Toshiaki Miyoshi, Ehime, Japan

[73] Assignee: Ohta Inc. (A.K.A. Ohta Kabushiki Kaisha), Okayama, Japan

[21] Appl. No.: 996,100

[22] Filed: Dec. 23, 1992

[51] Int. Cl.[5] ..... A61H 3/02

[52] U.S. Cl. ..... 135/71; 135/68; 135/72; 403/91; 403/325

[58] Field of Search ..... 135/65, 68, 71, 72, 135/73, 76; 280/819, 821; 297/5; 248/288.5; 403/90, 91, 324, 325

[56] References Cited

U.S. PATENT DOCUMENTS 2,575,681 11/1951 Peters ..... 135/68
2,630,128 3/1953 Slater ..... 403/325 X
2,788,793 4/1957 Abbott ..... 135/68
3,757,807 9/1973 Manzo ..... 135/68 X

FOREIGN PATENT DOCUMENTS 2800872 7/1979 Fed. Rep. of Germany ..... 135/68
3-292956 12/1991 Japan ..... A61H 3/02
482442 1/1970 Switzerland ..... 135/71

*Primary Examiner*—Carl D. Friedman
*Assistant Examiner*—Kevin D. Wilkens
*Attorney, Agent, or Firm*—Koda and Androlia

[57] ABSTRACT

A stick-like apparatus for a physically handicapped person including a grip handle and a forearm supporting rod which rotates together with respect to a main rod so that the user can sit in an easy posture and can easily impose force on the stick-like apparatus when he stands up from a chair or when he goes upstairs.

8 Claims, 6 Drawing Sheets

FIG. 9
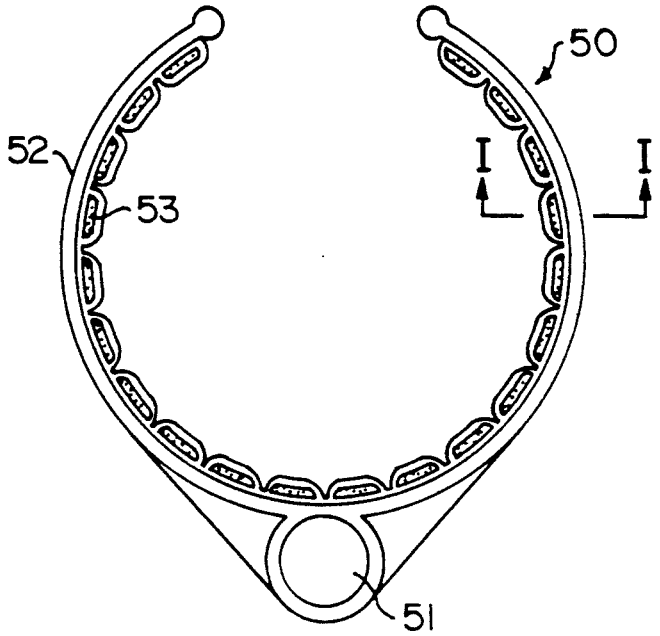
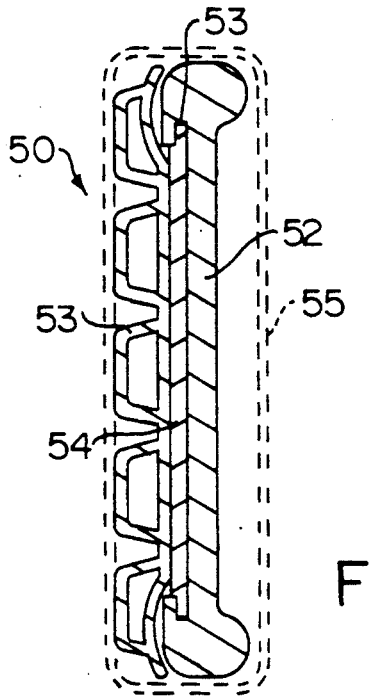
FIG. 10

STICK-LIKE MEANS FOR PHYSICALLY HANDICAPPED PERSON

BACKGROUND OF THE INVENTION

1. Industrial Field of the Invention

The present invention relates to stick-like means suitable for use by a physically handicapped person having an impediment in walking.

2. Description of the Prior Art

When a person having an impediment of the limbs due to cerebral apoplexy or the like, who has difficulty walking by himself, uses a stick for assistance, the stick had better be secured to his forehand instead of being merely grasped by his hand so that the stick may not become unsteady and he can walk easily and safely. For the reasons, a stick for a physically handicapped person including a grip handle to be grasped by the hand and a forearm supporting rod along which the forearm extends for retainment has conventionally been used. This kind of stick generally includes a forearm fixture attached to the forearm supporting rod.

In the conventional stick, a main rod, the grip handle and the forearm supporting rod are fixedly connected to one another and angles between the grip handle and the forearm supporting rod, between the forearm supporting rod and the main rod and between the main rod and the grip handle are always constant. In this connection, the handicapped person is satisfied with the stick when he walks on the flat ground, whereas he feels uncomfortable when he goes up stairs or sits on a chair, because the elbow is unnaturally lifted.

To solve the above-described defect of the prior art, a stick is designed such that a forearm supporting rod can be brought down with respect to a main rod and a grip handle. In this stick, however, since the grip handle is fixed to the main rod, the wrist and the forearm of the user are unfavorably turned unnaturally to cause pain to the user if he continues to grasp the grip handle when he sit on a chair. Further, the user cannot sufficiently impose force on the stick when he tries to stand up from the chair.

SUMMARY OF THE INVENTION

In order to solve the aforesaid problem of the prior art, the invention is arranged in such a manner as to be mentioned below.

That is to say, stick-means for a physically handicapped person according to the invention includes a grip handle to be grasped by the hand, a forearm supporting rod and a main rod whose lower end comes in contact with the ground, the stick-like means being characterized in that grip handle and the forearm supporting rod are connected to each other substantially at right angles, and an engagement portion between the grip handle and the supporting rod is rotatably attached at an upper end of the main rod so as to rotate the grip handle between a location where it extends forward and a location where it extends upward with respect to the main rod extending upright and to rotate the forearm supporting rod between a location where it extends upward and a location where it extends backward with respect to the upright-extending main rod.

In the stick-like means constructed in the above-described manner, because the grip handle and the forearm supporting rod rotates together with respect to the main rod, the forearm supporting rod is brought down and the grip handle is extended upright when the user sits on a chair. For this reason, the wrist and the forearm is not turned unnaturally so that the user takes an easy posture when he sits on the chair. Also, since the grip handle and the main rod are located substantially linearly, the user can easily impose force on the stick-like means when he stands up from the chair.

When the grip handle is rotated to reach its upper-limit location, or when the forearm supporting rod is brought down, an angle between the forearm supporting rod and main rod is predetermined at a value slightly smaller than 90°, the lower end of the main rod is positioned at a location nearer to the body of the user than the upper end. As a result, the user can stand up with the stick-like means being inclined slightly forward at its upper end, so that he can impose enough large force on the stick-like means downward when he tries to stand up. Accordingly, the user can stand up easily.

Further, when the pin for fixing an angle between the main rod and the grip handle is fitted in the recess, if the pin is inserted in the recess so that its top end passes the rotational center of the main rod and the grip handle, backlash between the main rod and the grip handle is not caused so that the handicapped person feels comfortable when he uses the stick-like means.

If an operation lever protruded downwardly from a lower side of a top end of said grip handle is adapted to advance or retreat the engagement pin, it is easy to lock the main rod and the grip handle or to release the same from locking.

For simplifying the structure of the stick-like means for a physically handicapped person according to the invention, in the rotating mechanism, an end portion of the engagement pin is formed in a shape of a one-sided cotter, and the engagement member is provided with a recess having a tapered surface whose inclination angle is ($\beta$) substantially equal to or smaller than a working face angle ($\alpha$) at the end portion of the engagement pin.

A portion of the lever for operating the engagement pin provided in the grip handle, the portion being protruded from the lower side of the grip handle, is reversely bent to a direction of rotating the lever, and an angle $\theta_2$ between the grip handle and the lever at a terminal position of rotation of the lever is predetermined at a value large enough not to nip the finger therebetween. Further, the grip handle is provided at its end portion with a guide recess for a rotational pin of the lever.

Additionally, an absorbing material is attached on an inner surface of a main body of a forearm fixture provided for securing the forearm to the forearm supporting rod.

Thanks to such improvement of the structure of the stick-like means, the backlash at the primary stage of use or play during use can be absorbed, and the user's finger is not nipped between the grip handle and the lever when he releases the locking of the lever. After assembling the lever, the grip cover can be fitted on the grip handle. Further, when the arm is inserted into the arm support portion, the force applied to the arm can be lessened by the absorbing material. Moreover, because an exchangeable cover is fitted on the grip handle, the stick-like means is always kept clean and the user can feel comfortable during use.

BRIEF DESCRIPTION OF DRAWINGS

FIG. 9 is a top plan view of a forearm fixture; and

FIG. 10 is an enlarged cross-sectional view of the forearm fixture, taken along a line I—I in FIG. 9.

DETAILED DESCRIPTION OF THE INVENTION

Figure 1:
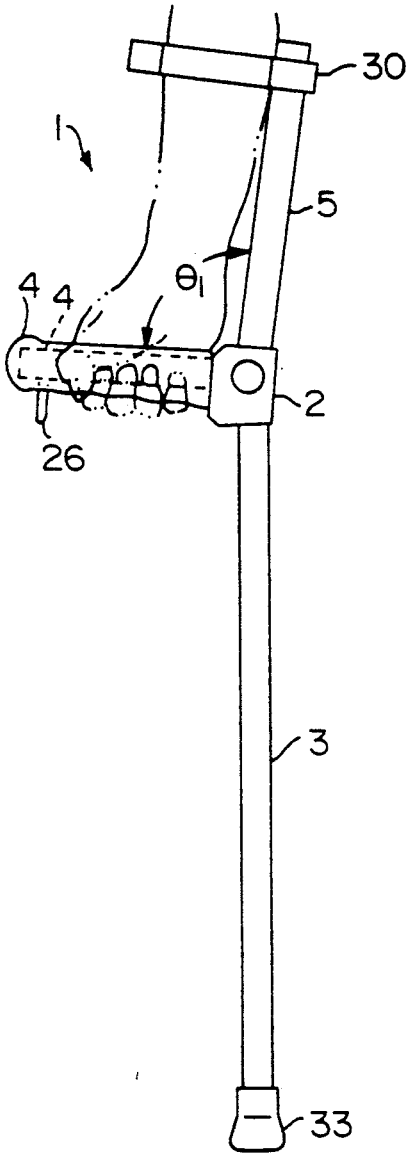
FIGS. 1 and 2 are views showing an appearance of stick-like means according to one embodiment of the invention, FIG. 1 illustrating a state of the stick-like means when the user is walking, and FIG. 2 illustrating a state of the same when the user is sitting.

Preferred embodiments of the invention will be described hereinafter with reference to the drawings.

FIGS. 1 to 5 show a certain example of stick-like means according to the invention. This stick-like means 1 includes a main rod 3, a grip handle 4 and a forearm supporting rod 5 all of which are made of light-weight alloy and radially extend around a pivotal portion 2.

Figure 3:
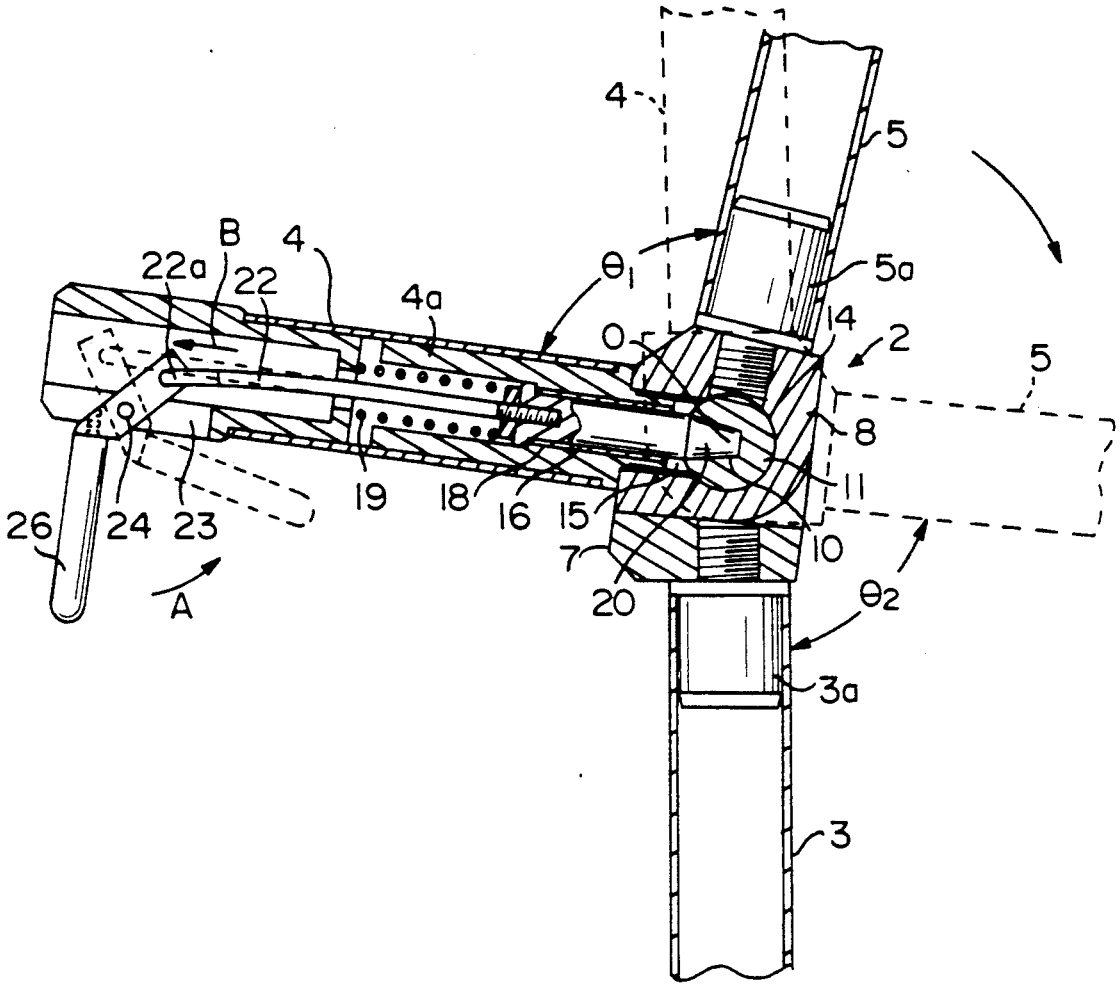
FIG. 3 is a cross-sectional view of an essential portion of the stick-like means.
Figure 4:
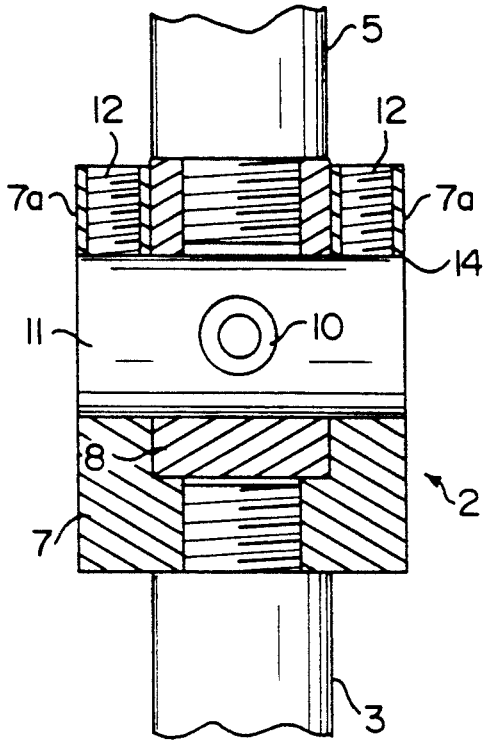
FIG. 4 is an explanatory view indicating a state of attachment of a second component of a pivotal portion and an engagement member.

At the pivotal portion 2, as shown in FIG. 3, a second component 8 of the pivotal portion 2 which is a common proximal portion of the grip handle 4 and the forearm supporting rod 5, is fitted in a first grooved component 7 of the pivotal portion 2 fixed on an upper end of the main rod 3. The grip handle 4 and the forearm supporting rod 5 are integrally united to each other by means of the second component 8. An angle $\theta$: between the grip handle 4 and the forearm supporting rod 5 is predetermined to be slightly larger than 90°. The angle $\theta_1$ is preferably selected at 93° to 100°, and it is more preferable when it is selected at 97°. In the illustrated embodiment of the stick-like means 1, the main rod 3 is screwedly connected to the first component 7 by means of a threaded member 3*a* secured to the rod 3. Also, the grip handle 4 and the supporting rod 5 are screwedly connected to the second component 8 by means of threaded members 4*a* and 5*a* secured to the grip handle 4 and the rod 5, respectively. As shown in FIG. 4, a cylindrical engagement member 11 having a recessed portion 10 opened toward the grip handle 4 is secured to both vertical portions 7*a*, 7*a* of the first component 7 by means of embedded bolts 12, 12 in such a manner that the engagement member 11 horizontally extends through the second component 8. The second component 8 is formed with a communication hole 15 which extends between a hollow portion of the grip handle 4 and a through hole 14 of the first component 7 for the engagement member 11. An engagement pin 16 is inserted in the communication hole 15. The engagement pin 16 illustrated at the central portion of FIG. 3 is slidable fitted in a split bush 18 securely attached to the threaded member 4*a* of the grip handle 4. The engagement pin 16 is urged toward the pivotal portion by means of a spring 19. The engagement pin 16 is provided at its top end with a projection or a truncated conical portion 20 to be fitted in the recessed portion 10. When the recessed portion 10 and the truncated conical portion 20 are engaged with each other, a distal end of the truncated conical portion 20 occupies a location in the recessed portion 10 to pass the rotating axis O of the engagement member 11.

One end of a rod 22 provided in the grip handle 4 is screwedly connected to a rear end of the engagement pin 16. The rod 22 includes a hook portion 22*a* formed at the other end, the hook portion 22*a* being bent into a U shape. An upper end of a lever 26, which is rotatably attached at a groove-like recessed portion 23 formed at the top end of the grip handle 4 on the lower side thereof by a check pin 24, is engaged with and connected to the hook portion 22*a*. The lever 26 is ordinarily projected downwardly from the top end lower portion of the grip handle 4.

When the lever 26 takes a position extending downwardly, such as shown in FIG. 3, the truncated conical portion 20 of the engagement pin 16 is inserted in the recessed portion 10 of the engagement member 11 by the urging force of the spring 19. As a result, the second component 8 is fixed to the first component 7, so that the grip handle 4 and the forearm supporting rod 5 cannot rotate with respect to the main rod 3. When the lever 26 is rotated in the counterclockwise direction or a direction of an arrow A, the lever takes a withdrawal position as viewed from the operating person. The engagement pin 16 simultaneously moves in a direction of arrow B together with the rod 22, and the truncated conical portion 20 comes out of the recessed portion 10. Consequently, the second component 8 becomes rotatable with respect to the first component 7. In FIG. 3, the grip handle 4 and the forearm supporting rod 5 is rotatable with respect to the main rod 3 during walking and sitting, from the location illustrated by a continuous line to the location illustrated by a dotted line. An angle $\theta_2$ defined between the main rod 3 and the forearm supporting rod 5 when the operating person is sitting, is designed to be smaller than 90°, preferably set at approximately 85°.

Figure 5:
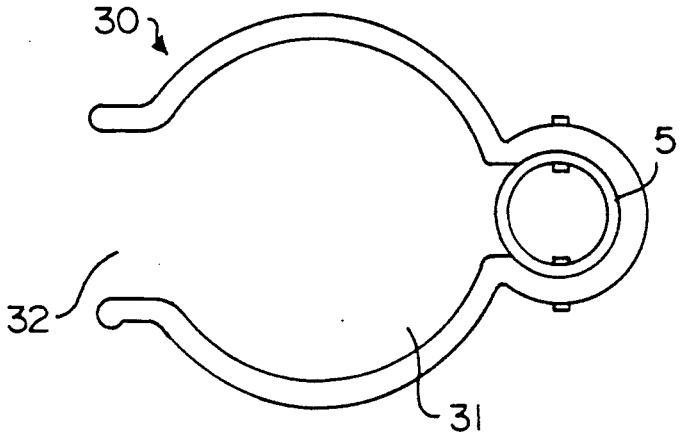
FIG. 5 is a top plan view of a forearm fixture.

In FIG. 1, a forearm fixture 30 is attached to a front side of an upper end portion of the forearm supporting rod 5 in an upright state. The forearm fixture 30 is made of an elastic material such as plastics. As shown in FIG. 5, the forearm fixture has a circular space through which a forearm of the user extends and an opening part 32 formed at its front side. An antislipping cap 33 is connected to a lower end of the main rod 3. A grip cover 34 is put on the grip handle 4. Further, each of the main rod 3 and the forearm supporting rod 5 may be provided with a length adjusting mechanism.

When the handicapped person walks, the stick-like means 1 is brought into the walking state as illustrated in FIG. 1. The forearm is extended through the space 31 of the forearm fixture 30 from above so as to grasp the grip cover 34 of the grip handle 4. Because the forearm is securely held by the forearm fixture of the forearm supporting rod 5, the stick-like means is steady so that the user is ensured to walk safely. In case of emergency, the opening part 32 is forced open for extracting the forearm out of the forearm fixture 30.

Figure 2:
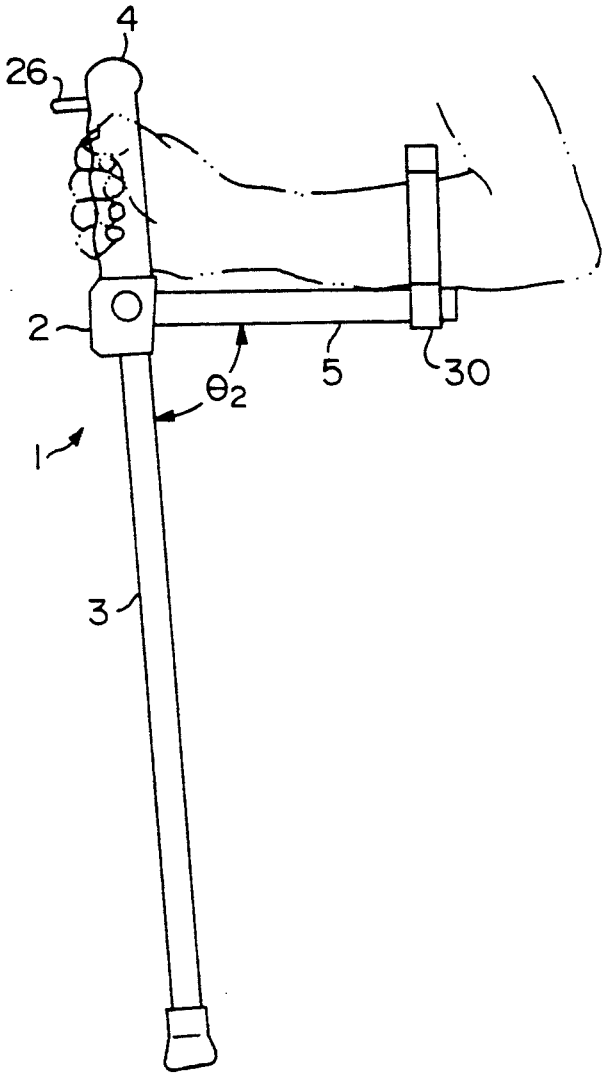

When sitting on a chair, a bench or the like, the forearm supporting rod 5 is brought down into the state illustrated in FIG. 2, while the lever 26 is being rotated in the counterclockwise direction. The lever 26 can readily be hooked by the forefinger of the person to pull toward the wall of the grip handle 4. The forearm supporting rod 5 and the grip handle 4 are united to each other, so that the grip handle 4 is brought into a state of extending upright. For the reasons, the user can continue to grasp the grip handle 4 during sitting, so that the stick-like means will not suddenly fall down and be juggled. When the user stands up from the chair, he can impose force on the stick-like means in a direction downwardly backwardly, whereby the person can stand up easily. Particularly, when the person sits down, in the case where the angle $\theta_2$ between the main rod 3 and the forearm supporting rod 5 is selected from 80° to 90°, preferably set at approximately 85°, the direction of the axis of the main rod 3 becomes substantially the same as that of the force imposed, so that the person can stand up more easily. Further, when the angle $\theta_2$ is smaller than 90°, the lower end of the main rod 3 is positioned at a location nearer to the body of the person than the upper end of the main rod 3. Accordingly, the stick-like means is not obstructive to passersby walking in front of the user of the stick-like means.

Figure 6:
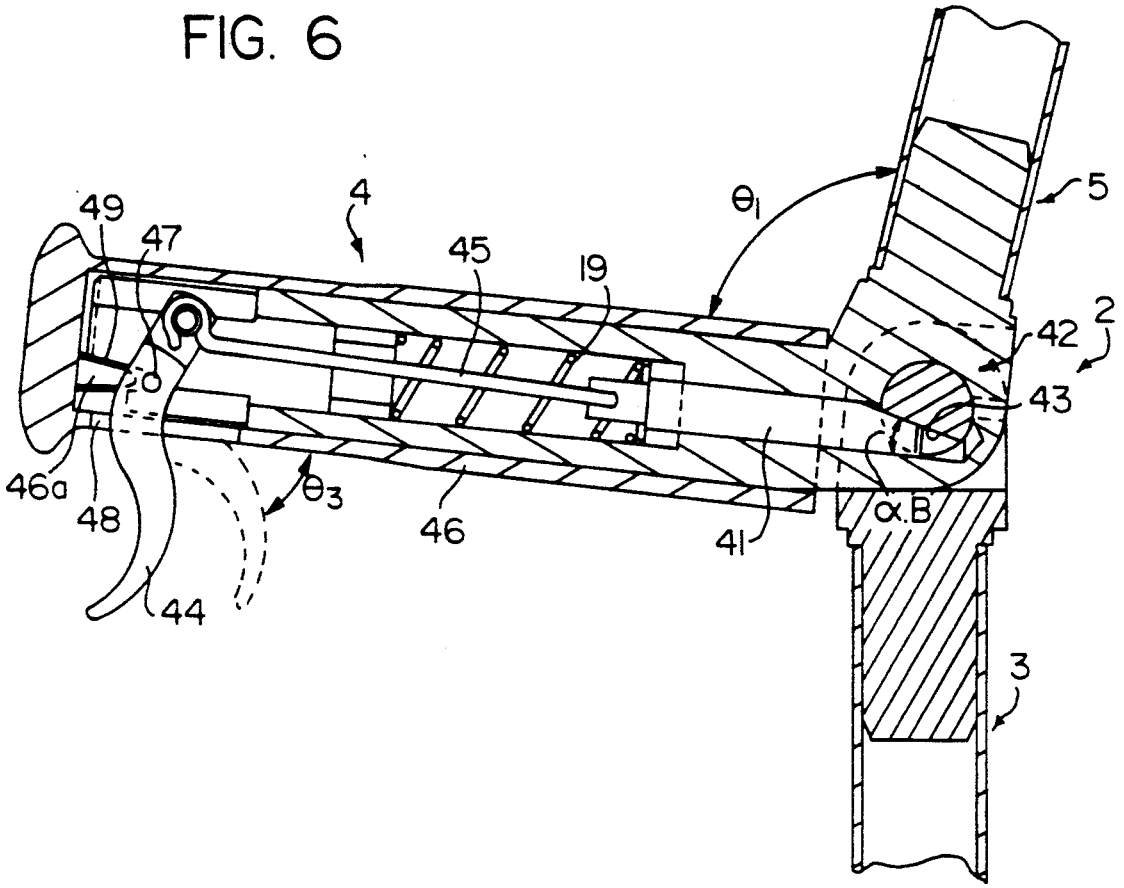
FIG. 6 is a cross-sectional view of an essential portion of stick-like means for a physically handicapped person according to another embodiment of the invention, similarly to FIG. 3.
Figure 7:
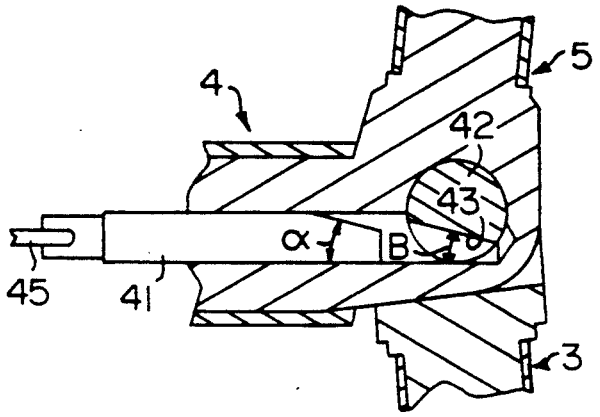
FIG. 7 is a cross-sectional view in the case where an engagement pin is disconnected from an engagement member.
Figure 8:
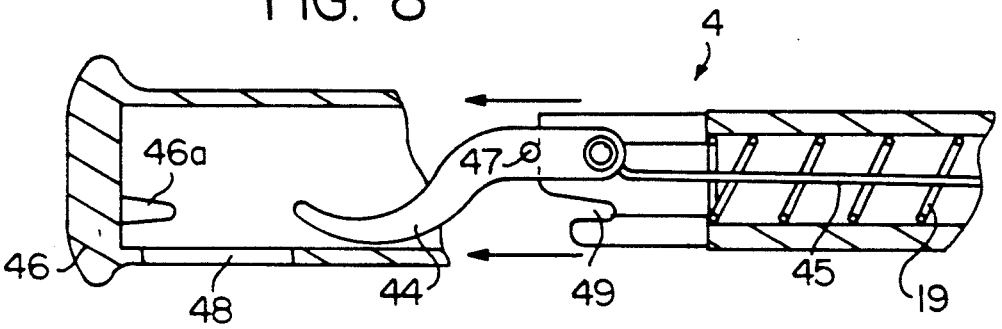
FIG. 8 is a cross-sectional view showing a condition in which a grip cover is being attached on a grip handle.

FIGS. 6 to 8 illustrate another embodiment of a stick-like means of the invention. FIG. 6 is a cross-sectional view showing a condition in which a grip handle 4 and a forearm supporting rod 5 are locked with respect to a main rod 3 in an upright extending state by means of an engagement pin 41 while the grip handle 4 is protruded forward and the forearm supporting rod 5 is protruded upward. The engagement pin 41 serves to prevent rotation of the forearm supporting rod 5 provided at the angle of $\theta_1$ with respect to the grip handle 4. FIG. 7 illustrates a pivotal portion of the stick-like member in which the grip handle 4 and the forearm supporting rod 5 are not locked with respect to the main rod 3. As clearly understood from FIG. 7, an end portion of the engagement pin 41 is formed in a shape of a one-sided cotter having a working face angle ($\alpha$). Further, an engagement member 42 is provided with a recess 43 having a tapered surface whose inclination angle is $\beta$ with respect to a tangent thereof. The inclination angle ($\beta$) is predetermined to be substantially equal to the working surface angle ($\alpha$) at the end portion of the engagement pin 41. It is more preferable to select the inclination angle at a value slightly smaller than the working surface angle, since backlash between the engagement pin 41 and the recess 43 is minimized.

The engagement pin 41 is communicated to a lever 44 of the grip handle 4 via a connection rod 45. The spring 19 is provided around the connection rod 45 for always elastically urging the engagement pin 41 toward the recess of the engagement member to lock the grip handle 4 and the forearm supporting rod 5.

An angle $\theta_3$ between the grip handle 4 and the lever 44 at a terminal position of rotation of the lever is selected at a value large enough not to nip the finger of the user between the lever 44 and the grip handle 4 when the lever 44 is pulled to bring the engagement pin 41 into the non-locking state. A portion of the lever 44 protruded from the grip handle 4 is bent for facilitating the finger action of pulling the lever, differently from the lever 26 in the first example of the stick-like means of the invention.

FIG. 8 shows a process in which the grip handle 4 is being fitted into a grip cover 46. In the first example shown in FIG. 3, for convenience of assembling of the lever, the lever 26 is divided into two parts which are connected to each other after the grip cover is attached on the grip handle. One of the lever parts is accommodated in the grip handle and the other part is straight and is screwedly connected to the one part of the lever. In contrast with this, in the second embodiment of the invention, the grip cover 46 is put on the grip handle 4 after attaching the lever 44 to the connection rod 45. For facilitating the attachment of the lever, a guide recess 49 is provided at an end of the grip handle 4 for guiding a rotational pin 47 of the lever 44 to an inlet of the grip cover 46 and for protruding the lever 44 from an elongated hole 48 of the grip cover 46. The bottom portion of the guide recess 49 acts to rotatably support the rotational pin 47. The rotational pin 47 which has been received in the guide recess 49 is restrained from movement in the leftward direction of FIG. 6 by a projection **46*a* provided on an inner wall of the grip cover 46**.

As shown in FIG. 9, a forearm fixture 50 for securing the person's forearm to the forearm supporting rod 5 is an improved one of the forearm fixture 30 illustrated in FIG. 5. In the forearm fixture 50, a load applied to the arm is lessened by an absorbing material 53 when the arm is inserted through the fixture. A main body 52 of the forearm fixture 50 is opened at its one portion and it includes a mounting hole 51 at its proximal portion through which the forearm supporting rod 5 extends. The absorbing material 53 is adhered on an inner wall of the annular main body 52 of the forearm fixture 50 via a base liner 54 which can be inserted into a recess 55 of the main body 52. The absorbing material 53 is adhered to the forearm fixture 50 by an adhesive, fusion, or the like. Besides, the forearm fixture 50 may be provided with a cover having a bag in which the absorbing material is filled. Various kinds of materials such as rubber, flexible plastics, air or elastic tube made of these materials filled with air are used as the absorbing material. An exchangeable cloth cover 55 may be fitted on the surface of the absorbing material.

As clearly understood from the above description, the stick-like means for a physically handicapped person according to the invention is arranged in such a manner that the grip handle and the forearm supporting rod rotates together with respect to the main rod. As a result, the user can takes an easy posture when he sits and he can readily impose force on the stick-like means when he stands up from the chair or goes up stairs, so that the can stand up or walk up safely and easily.

Further, according to the invention, it becomes possible to provide stick-like means for a physically handicapped person which is safe in walking and comfortable upon use, and whose components are small in number and assembling cost is low.

What is claimed is:

1. Stick-like means for a physically handicapped person including a grip handle to be grasped by the hand, a forearm supporting rod and a main rod whose lower end comes in contact with the ground, wherein said grip handle and said forearm supporting rod are connected to each other substantially at right angles, and an engagement member between said grip handle and said supporting rod is rotatably attached at an upper end of the main rod so as to rotate the grip handle between a location where it extends forward and a location where it extends upward with respect to the main rod extending upright and to rotate the forearm supporting rod between a location where it extends upward and a location where it extends backward with respect to the upright-extending main rod, and wherein an engagement pin provided in said grip handle is inserted in a recessed portion formed in said engagement member between the grip handle and the forearm supporting rod under such a condition that grip handle extends forward, so that the engagement pin locks the grip handle and the forearm supporting rod with respect to the main rod, and said engagement pin is extracted from said recessed portion of said engagement member for releasing the grip handle and the forearm supporting rod from being locked except when the grip handle extends forward.

2. Stick-like means for a physically handicapped person according to claim 1 wherein said engagement pin for fixing said grip handle with respect to said main rod is inserted in said recessed portion so that its top end passes through the rotational center of the grip handle and the supporting rod.

3. Stick-like means for a physically handicapped person according to claim 1, wherein an angle $\theta_3$ between said forearm supporting rod and said main rod is predetermined at a value slightly smaller than 90° when the grip handle is rotated to reach its upper-limit location.

4. Stick-like means for a physically handicapped person according to claim 2 or 3, wherein an operation lever protruded downwardly from a lower side of a top end of said grip handle acts to advance or retreat said engagement pin.

5. Stick-like means for a physically handicapped person according to claim 4, wherein a portion of the lever for operating the engagement pin provided in the grip handle, the portion being protruded from the lower side of the grip handle, is reversely bent to a direction of rotating the lever, and an angle $\theta_3$ between the grip handle and the lever at a terminal position of rotation of the lever is predetermined at a value large enough not to nip the finger therebetween.

6. stick-like means for a physically handicapped person according to claim 5, wherein said grip handle is provided at its end portion with a guide recess for guiding a rotational pin of the lever.

7. Stick-like means for a physically handicapped person according to claim 1, wherein an end portion of said engagement pin is formed in a shape of a one-sided cotter, and said engagement member is provided with a recess having a tapered surface whose an inclination angle ($\beta$) is substantially equal to or smaller than a working face angle ($\alpha$) at the end portion of said engagement pin.

8. Stick-like means for a physically handicapped person according to claim 1, wherein an absorbing material is attached on an inner surface of a main body of a forearm fixture provided for securing the forearm to the forearm supporting rod.

* * * * *